US006808131B2

(12) United States Patent
Bosio

(10) Patent No.: US 6,808,131 B2
(45) Date of Patent: Oct. 26, 2004

(54) PULL-OUT KITCHEN SPRAYER

(75) Inventor: Orlando Bosio, Casaloldo (IT)

(73) Assignee: Amfag S.p.A., Castel Goffredo (IT)

( * ) Notice: Subject to any disclaimer, the term of this patent is extended or adjusted under 35 U.S.C. 154(b) by 0 days.

(21) Appl. No.: 10/401,968

(22) Filed: Mar. 31, 2003

(65) Prior Publication Data

US 2003/0189107 A1 Oct. 9, 2003

(30) Foreign Application Priority Data

Apr. 4, 2002 (IT) ..... MN2002A0014

(51) Int. Cl.[7] ..... A62C 31/00

(52) U.S. Cl. ..... 239/447; 239/449; 239/558; 239/562; 239/600

(58) Field of Search ..... 239/446–449, 239/583, 558, 562, 600

(56) References Cited

U.S. PATENT DOCUMENTS 5,201,468 A * 4/1993 Freier et al. ..... 239/383
5,758,690 A 6/1998 Bischoff et al.
5,924,451 A 7/1999 Kuo
6,381,770 B1 5/2002 Raisch

FOREIGN PATENT DOCUMENTS

EP 1 232 801 8/2002

* cited by examiner

*Primary Examiner*—Christopher Kim
(74) *Attorney, Agent, or Firm*—Guido Modiano; Albert Josif; Daniel O'Byrne

(57) ABSTRACT

A pull-out kitchen sprayer, comprising a central body accommodated within an outer enclosure, designed to convey water between an inlet associated with a flexible water feed hose and an outlet disk that comprises a central passage and peripheral passages, and comprising a switching device, and two elements constituted by the central body and by the outlet disk that are provided with arrangements for mutual locking with the interposition of a raised portion that protrudes from the internal surface of the enclosure, to lock the enclosure with respect to the elements.

7 Claims, 3 Drawing Sheets

PULL-OUT KITCHEN SPRAYER

BACKGROUND OF THE INVENTION

The invention relates to a pull-out kitchen sprayer.

The great diffusion achieved by so-called kitchen sprayers or shower heads is known; such kitchen sprayers are connected to a flexible hose, so that they can be pulled out of faucets in order to reach distant positions within the sinks, and convey water with the possibility to provide the outflow of the water as a central jet or as a peripheral jet by operating a switching device provided for this purpose.

Said sprayers or shower heads comprise a central body, which is designed to convey the water to an outlet disk, and an outer enclosure, which in sprayers of the background art is required to perform not only the aesthetic functions pertaining thereto but also structural functions by cooperating in the assembly of the individual components of said sprayers.

This leads to the circumstance that the material that constitutes the enclosure of said sprayers is subjected to significant stresses, and this fact is a limitation in the design of the enclosure made of plastics, since materials that are particularly valid from an aesthetic standpoint can be used only with particular adjustments and without always achieving a high degree of safety from the mechanical standpoint.

SUMMARY OF THE INVENTION

The aim of the present invention is therefore to provide a pull-out kitchen sprayer whose structure is such that it does not entail stresses within the outer enclosure, so as to allow to adopt without particular difficulties any plastic material for the manufacture of said enclosure.

The proposed aim is achieved by a pull-out kitchen sprayer according to the invention, characterized in that the two elements formed by the central body and by the outlet disk are provided with means for mutual locking with the interposition of a raised portion that protrudes from the internal surface of the enclosure, said enclosure being thus locked with respect to said elements.

BRIEF DESCRIPTION OF THE DRAWINGS

Further characteristics and advantages of the present invention will become better apparent from the description of a preferred but not exclusive embodiment thereof, illustrated only by way of non-limitative example in the accompanying drawings, wherein.

DESCRIPTION OF THE PREFERRED EMBODIMENTS

Figure 1:
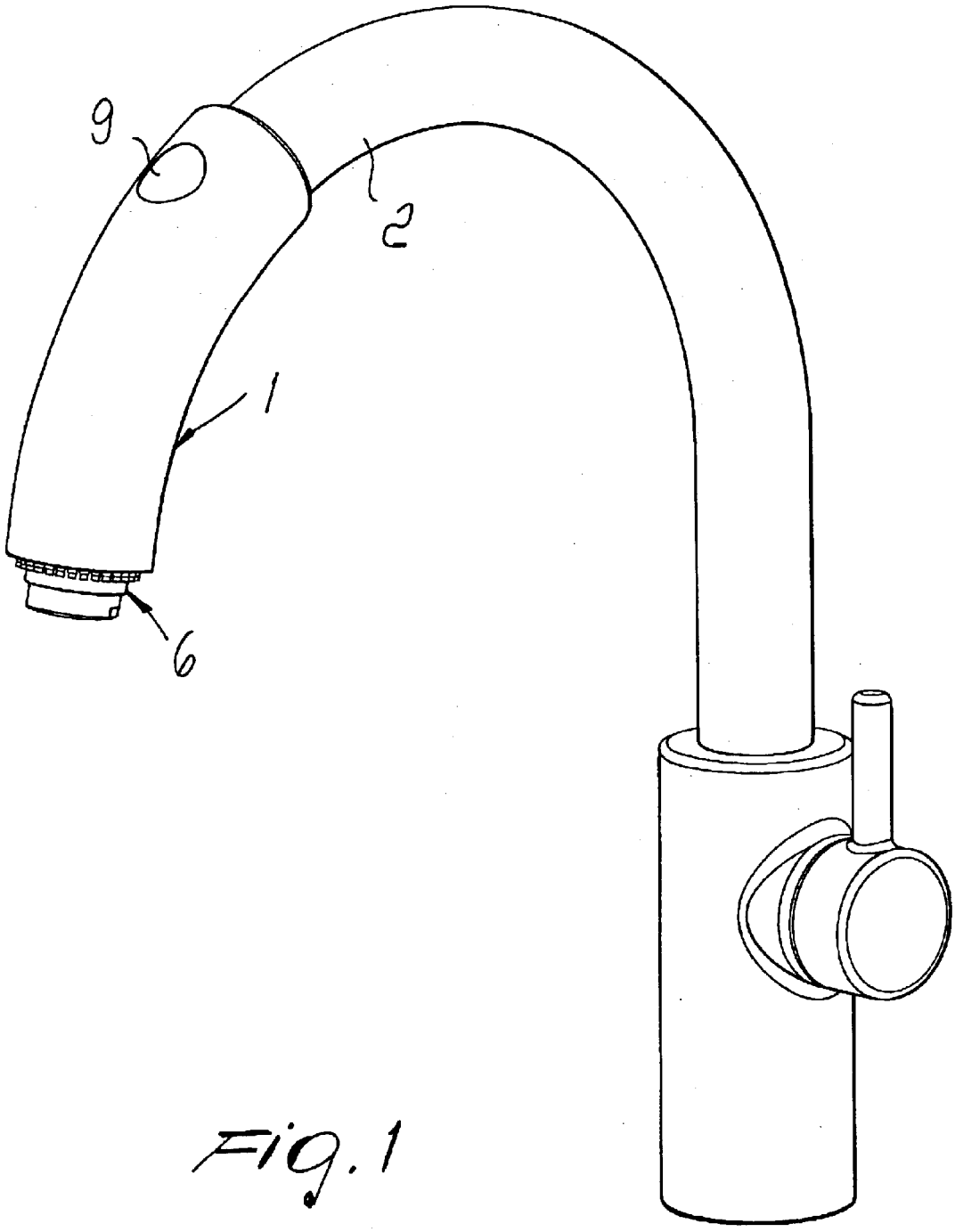
FIG. 1 is a view of the sprayer mounted on a faucet.
Figure 2:
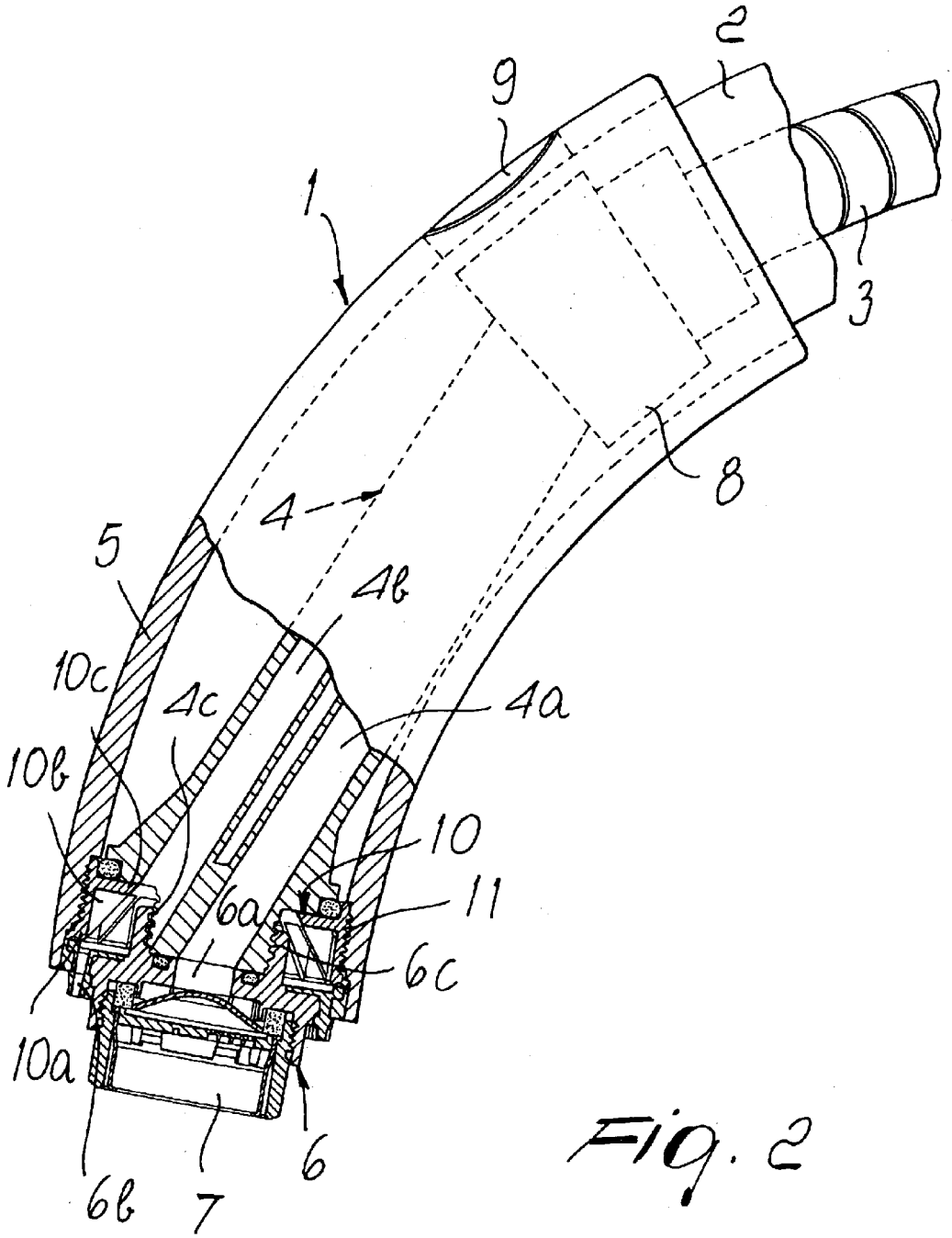
FIG. 2 is a partial sectional view of the sprayer.
Figure 3:
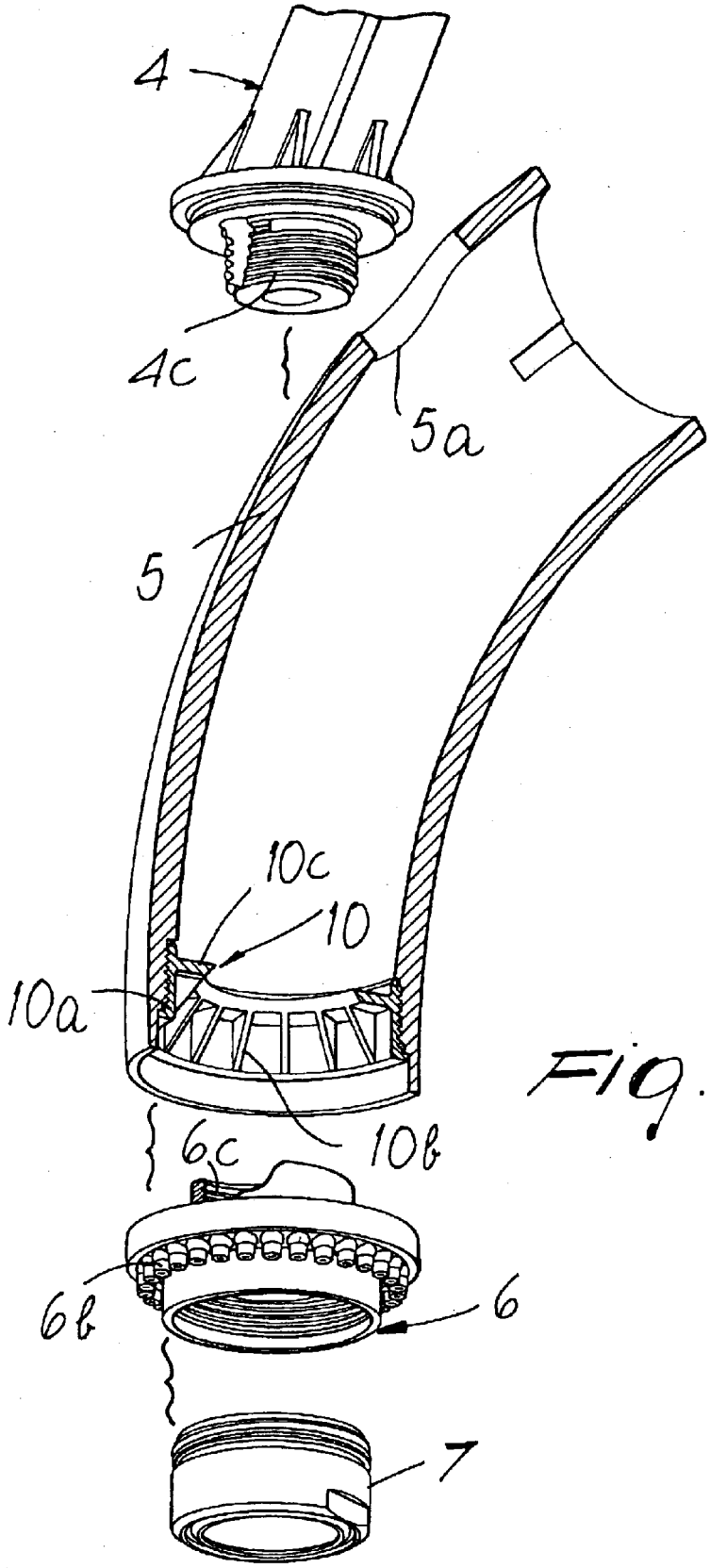
FIG. 3 is an exploded view of the sprayer.

With reference to the figures, the reference numeral 1 generally designates the pull-out sprayer or shower head in contact with the tubular body 2 of the faucet that is designed to contain the flexible water feed hose 3.

More specifically, said sprayer comprises the central body 4, which is accommodated within the outer enclosure 5 and is designed to convey the water between an inlet, which is associated with the flexible hose 3, and the outlet disk 6, which comprises the central passage 6*a*, provided with the assembly constituted by the aerator and the filters 7, and the peripheral passages 6*b*.

A switching device 8, whose description is not made here, is comprised within the central body 4 and can be accessed by a user by way of the opening 5*a* of the enclosure, which is provided with an elastic cap 9 in order to provide the access of the water selectively to the duct 4*a* connected to the central passage 6*a* and to the duct 4*b* connected to the peripheral passages 6*b*.

An important feature of the invention is the fact that the central body 4 and the outlet disk 6 are provided with locking means, such as complementary threads, respectively a male thread 4*c* and a female thread 6*c*, for producing mutual locking with the interposition of a raised portion 10 that comprises a ring 10*a* associated with the enclosure 5 by means of a locking thread 11, with ribs 10*b* for connection to an annular tab 10*c*.

The mutual locking of the two elements constituted by the central body 4 and the outlet disk 6 clamps the raised portion 10 between them and consequently locks the enclosure 5 with respect to the sprayer assembly without subjecting the material of said enclosure to any stress.

The raised portion 10 can of course be applied to the enclosure 5 in any manner and can also be provided monolithically with it.

The described invention is susceptible of numerous modifications and variations, all of which are within the scope of the appended claims: thus, for example, the raised portion 10 can be provided as discontinuous segments.

The disclosures in Italian Patent Application No. MN2002A000014 from which this application claims priority are incorporated herein by reference.

What is claimed is:

1. A pull-out kitchen sprayer, comprising:

an outer enclosure;

a central body accommodated within the outer enclosure, for conveying water between an inlet associated with a flexible water feed hose, said central body having a water inlet end and a water outlet end which are mutually oppositely arranged, said central body extending between said inlet end and said outlet end thereof;

an outlet disk that comprises a central passage and peripheral passages connected to respective water ducts;

a switching device connected to the water inlet end of said central body for providing access for the water selectively to the duct connected to said central passage and to the duct connected to said peripheral passages;

a raised portion that is connected to and protrudes from an internal surface of the enclosure; and locking means for mutually locking the water outlet end of said central body and the outlet disk such that the raised portion is interposed and clamped directly between the water outlet end of said central body and the outlet disk, said enclosure being thus locked with respect to said water outlet end of said central body and said outlet disk for reducing stresses on said enclosure.

2. The sprayer of claim 1, wherein said locking means for locking said central body and said outlet disk with said raised portion clamped therebetween comprise complementary threads of said central body and said outlet disk.

3. The sprayer of claim 1, wherein said raised portion that protrudes from the internal surface of the enclosure extends over an entire perimeter of said internal surface.

4. The sprayer of claim 3, wherein said raised portion is applied to said enclosure.

5. The sprayer of claim 4, wherein said raised portion applied to said enclosure is associated thereto by way of a locking thread.

6. The sprayer of claim 3, wherein said raised portion is formed monolithically with said enclosure.

7. A pull-out kitchen sprayer, comprising:

an outer enclosure;

a central body accommodated within the outer enclosure, for conveying water between an inlet associated with a flexible water feed hose, said central body having a water inlet end and a water outlet end which are mutually oppositely arranged, said central body extending between said inlet end and said outlet end thereof;

an outlet disk that comprises a central passage and peripheral passages connected to respective water ducts;

a switching device connected to the water inlet end of said central body for providing access for the water selectively to the duct connected to said central passage and to the duct connected to said peripheral passages;

a raised portion that is connected to and protrudes from an internal surface of the enclosure; and complementary threads of said central body and said outlet disk for mutually locking the water outlet end of said central body and the outlet disk such that the raised portion is interposed and clamped directly between the water outlet end of said central body and the outlet disk, said enclosure being thus locked with respect to said water outlet end of said central body and said outlet disk for reducing stresses on said enclosure.

* * * * *